US006986683B2

(12) United States Patent
Lazaro, Jr.

(10) Patent No.: US 6,986,683 B2
(45) **Date of Patent: *Jan. 17, 2006**

(54) ELECTRICAL COUPLINGS AND COMPONENTS

(76) Inventor: Luis J. Lazaro, Jr., The Boeing Company, P.O. Box 3707, M/S 13-08, Seattle, WA (US) 98124-2207

( * ) Notice: Subject to any disclaimer, the term of this patent is extended or adjusted under 35 U.S.C. 154(b) by 189 days.

This patent is subject to a terminal disclaimer.

(21) Appl. No.: 10/277,005

(22) Filed: Oct. 17, 2002

(65) Prior Publication Data

US 2003/0032324 A1 Feb. 13, 2003

Related U.S. Application Data

(63) Continuation of application No. 09/645,099, filed on Aug. 23, 2000, now Pat. No. 6,514,104, which is a continuation-in-part of application No. 08/986,378, filed on Dec. 8, 1997, now Pat. No. 5,989,065, which is a continuation-in-part of application No. 08/687,082, filed on Jul. 23, 1996, now abandoned, which is a continuation-in-part of application No. 08/521,776, filed on Aug. 31, 1995, now abandoned, which is a continuation-in-part of application No. 08/435,122, filed on May 5, 1995, now abandoned.

(51) Int. Cl.
*H01R 13/648* (2006.01)

(52) U.S. Cl. ..... 439/609

(58) Field of Classification Search ..... 439/607–610, 439/320

See application file for complete search history.

(56) References Cited

U.S. PATENT DOCUMENTS

| | | | | |
|---|---|---|---|---|
| 3,609,632 | A * | 9/1971 | Vetter | 439/258 |
| 3,678,445 | A * | 7/1972 | Brancaleone | 439/609 |
| 4,423,919 | A * | 1/1984 | Hillis | 439/609 |
| 5,580,278 | A * | 12/1996 | Fowler et al. | 439/609 |
| 6,146,204 | A * | 11/2000 | Lazaro, Jr. | 439/609 |
| 6,514,104 | B1 * | 2/2003 | Lazaro, Jr. | 439/609 |

* cited by examiner

*Primary Examiner*—Khiem Nguyen
(74) *Attorney, Agent, or Firm*—Conrad O. Gardner; Laurence A. Savage

(57) ABSTRACT

A grounding contact member for electrically connecting cooperating metal shells in a coupling comprises a metal band divided along both edges into several spring contact fingers that are bent inwardly into two U-shape portions. The contact member is located in an annular recess around the inside of a coupling ring with the fingers at one end engaging the metal shell on which the coupling ring is mounted and the fingers at the other end engaging the other metal shell to which the coupling ring is connected.

8 Claims, 2 Drawing Sheets

ELECTRICAL COUPLINGS AND COMPONENTS

CROSS-REFERENCE TO RELATED APPLICATIONS

This application is a continuation application of application Ser. No. 09/645,099, filed Aug. 23, 2000 now U.S. Pat. No. 6,514,104, which is a continuation-in-part of application Ser. No. 08/986,378, filed Dec. 8, 1997, now U.S. Pat. No. 5,989,065 which was a continuation-in-part of application Ser. No. 08/687,082, filed Jul. 23, 1996, now abandoned which was a continuation-in-part of application Ser. No. 08/521,776, filed Aug. 31, 1995 now abandoned which was a continuation-in-part of application Ser. No. 08/435,122 filed May 5, 1995 now abandoned.

BACKGROUND OF THE INVENTION

The present invention relates to electrical couplings and components of couplings. The invention is more particularly concerned with couplings having grounding fingers that establish electrical connection between parts.

Electrical couplings, such as those between electrical cable clamps to electrical connectors or the like, often have an outer metal shell in several parts that are retained with one another by means of a coupling ring. The coupling ring is rotatably mounted on one part of the coupling and is internally threaded, so that it can be screwed onto the cooperating other part of the coupling to draw parts into mating engagement. The metal shell of the coupling usually provides a part of a ground path for an assembly in which the coupling is connected. While there is electrical connection between the parts of the coupling via the interfacing accessory teeth on the electrical connector and cable clamp, this in many assemblies, provide only a poor electrical connection or high resistance conductivity because of sloppy engagement between interfacing accessory teeth and also compounded by the presence of contaminants such as dirt or grimes or rust or poor assembly.

The present invention provides an improved, reliable and consistent electrical continuity between an electrical connector and its cable clamp or "backshell" by use of spring contact grounding fingers secured on one part of the coupling (such as by welding or solder), the fingers being arranged to make a sliding electrical contact with the other part of the coupling when the two are coupled together. The grounding fingers ensure a solid electrical continuity and maintain this continuity even if the two parts of the coupling are not fully mated.

It can be understood that the present invention also provide an improved, reliable and consistent electrical continuity between an electrical connector and its coupling part such as a bracket or panel or structure in the aircraft. The grounding fingers ensures a solid electrical continuity and maintain this continuity even if the connector mounting screws were insufficient in having the two parts of the coupling fully mated. This present invention grounding fingers is an improvement to the straight wave springs described in application Ser. No. 08/986,378.

BRIEF SUMMARY OF THE INVENTION

It is an object of the present invention to provide a spring contact grounding fingers which solves the problems of the prior art.

It is another object of the present invention to provide an electrical coupling comprising: a first metal member of circular section; a second rotatable member mounted on a part of the first member, an annular recess formed around on inner surface of the second member or an outer surface of the first member; and an electrical contact member located in the annular recess, the contact member having a plurality of spring contact fingers extending axially of the coupling, the contact member being arranged to engage the outer surface of the first member and the inner surface of the second member such that the contact member makes electrical contact with at least the first member.

The contact fingers are preferably bent inwardly of the contact member. The contact member may include an annular band encircling the first member and integral with the fingers, the fingers projecting from the opposite edges of the band. The spring contact grounding may be of beryllium copper. The first member may be a first shell and the second member a coupling ring, the annular recess being formed around the inner surface of the coupling ring. The annular band of the contact member is axially installed on the first shell thus the other end of the contact member is arranged for contact with an outer surface of a second shell. The contact member may be entirely enclosed within the coupling ring.

It is a further object of the present invention to provide an electrical coupling comprising: a first metal shell of circular section; a coupling ring mounted on a part of the first shell, the coupling ring being arranged to engage a surface of a part of a second shell; an annular recess formed around an inner surface of the coupling ring; and the contact member having a plurality of spring contact fingers extending axially of the coupling and (for this description but not limited to) bent inwardly into first and second resilient U-shape portions at opposite ends, the contact member being arranged to engage the outer surface of the first shell and an outer surface of the second shell such that the contact member makes a low impedance connection between the two shells.

Yet another object of the present invention to provide an electrical coupling comprising: a first member of circular section; a second rotatable member mounted on a part of the first member; an annular recess formed around an outer surface of the first member; and an electrical contact member located in the annular recess, the contact member having a plurality of contact fingers extending axially of the coupling and bent inwardly into first and second resilient U-shaped portions at opposite ends of each finger, the fingers at both ends of the contact member engaging the recess in the first member and an outer surface of the contact member engaging the inner surface of the second member such that the contact member makes electrical and low impedance connection between the first and second members.

A still further object of the present invention to provide a contact member for making electrical and low impedance connection between different parts of a coupling assembly, the contact member comprising: a circular band of resilient metal having fingers along opposite edges of the band, the fingers being bent inwardly to form resilient U-shape portions such that the contact member can be retained in an annular recess in the coupling with the fingers along opposite edges establishing low impedance connection between different parts.

It is also an object of the present invention to provide a contact member for making electrical and low impedance connection between different parts of a coupling, the contact member comprising: a circular band of resilient metal, a plurality of contact fingers along opposite edges of the band, the fingers being bent inwardly to form resilient U-shape portions such that the contact member can be retained in an annular recess in one of the parts of the coupling with the fingers making electrical contact with the one part and with an outer surface of the contact member contacting an inner surface of the other part such that the contact member establishes a solid and consistent electrical connection between the two parts.

DETAILED DESCRIPTION OF THE INVENTION

Figure 1:
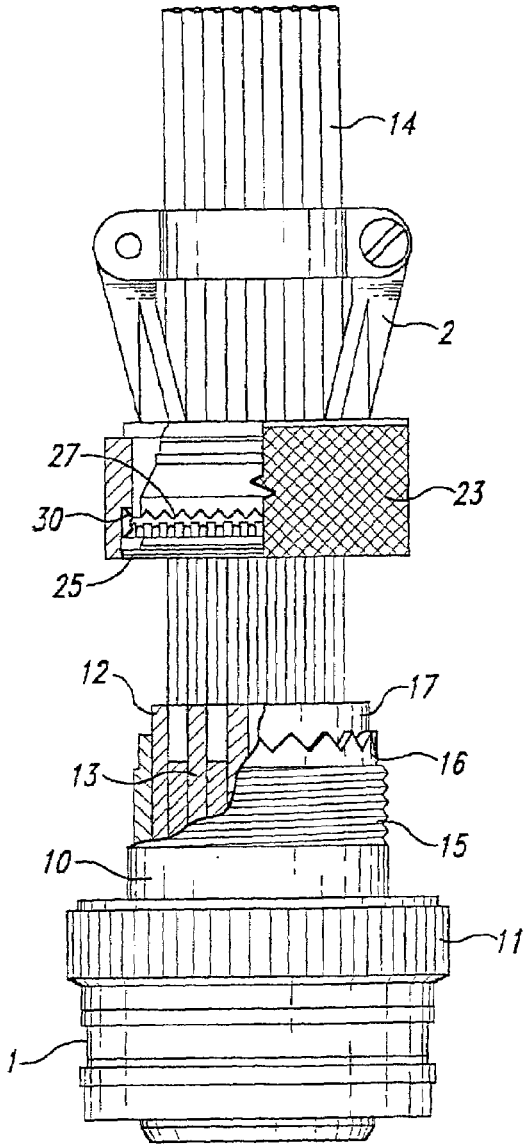
FIG. 1 is an exploded, partly cut-away elevation view of the coupling.

The electrical coupling comprises a forward part in the form of an electrical connector 1 and a rear part in the form of a cable clamp or backshell 2 that is, in use, secured to the rear of the electrical connector 1.

The electrical connector 1 shown for this description is a Plug that has a first outer metal shell 10 supporting a coupling ring 11 at its forward end by means of which the coupling is secured via a retaining ring (not shown). Inside the shell 10 an electrically insulated grommet 12 supports plurality of electrical contacts 13, which may be either sockets or pins, the contacts being connected to respective wires 14 extending rearwardly. The grommet 12 projects a short distance beyond the rear end of the shell 10. On its outer surface, the shell 10 has a screw thread 15 spaced from the rear end by a smooth, annular contact region 16. A series of triangular teeth 17 (designated as MS3155 accessory teeth) extends around the rear end of the shell 10.

Figure 2:
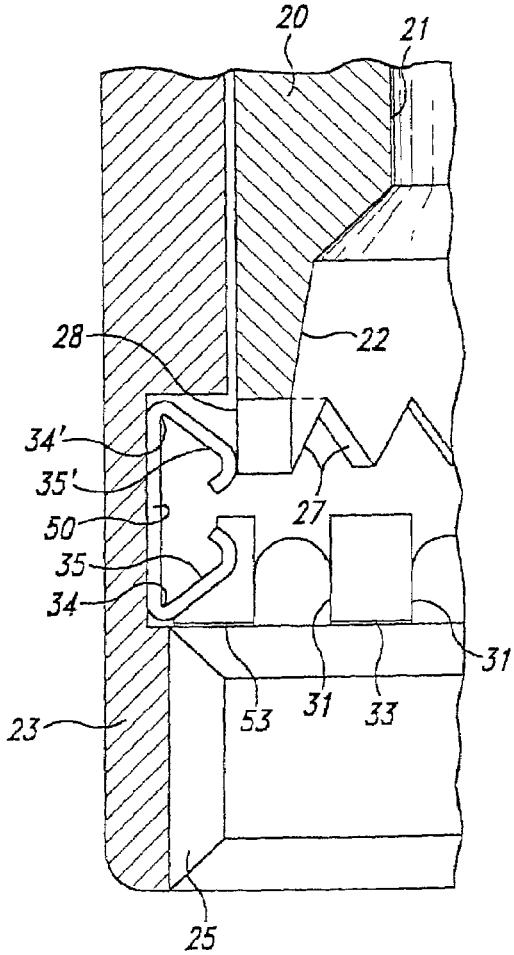
FIG. 2 is a sectional elevation view of a part of the coupling to a larger scale.
Figure 3:
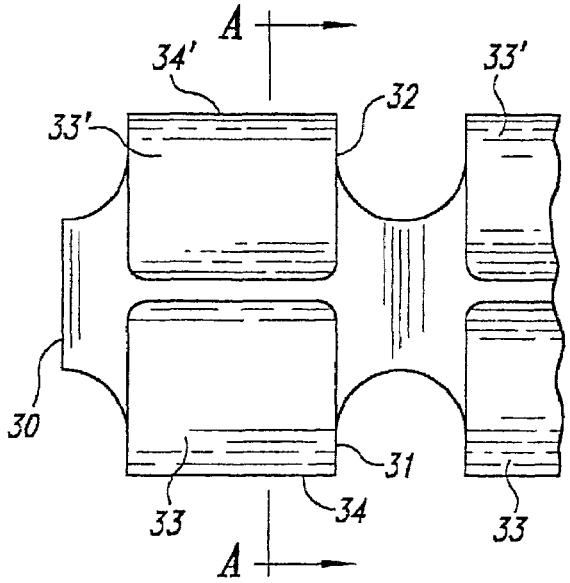
FIG. 3 is an elevation view of an inner surface of the contact member.
Figure 4:
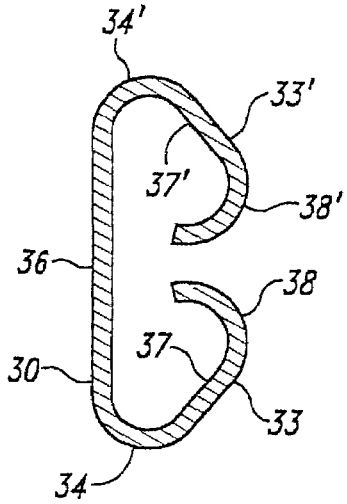
FIG. 4 is a sectional view of the contact member along the line A—A of FIG. 3.

The cable clamp or backshell 2 has a second outer metal shell 20 shown in FIG. 2 with a slightly smaller external diameter than that of the first shell 10 in the electrical connector 1. The shell 20 is similarly provided with MS3155 accessory teeth 27 at its forward end shaped to lock into the teeth 17 on the shell of connector 1. The shell 20 is hollow with a bore 21 extending along its length through which extend the wires 14. At its forward end, the bore has a tapered portion 22 adapted to envelope the projecting rear end of the grommet 12 when the two parts are secured together. A backshell coupling ring 23 is rotatably mounted on the shell 20 and project from its forward end. On its surface at its forward end, the ring 23 has a thread 25 shaped to engage the external thread 15 on the shell 10 of the connector 1. Just rearwardly of the thread 25, the ring 23 has an internal annular recess 26 of rectangular section. The recess 26 extends rearwardly approximately with the base of the teeth 27 so that the forward end of the teeth 27 project about half way along the length of the recess.

The backshell 2 also includes an electrical grounding contact member 30 clipped within the coupling ring 23. The contact member 30 is a strip or band of conductive, spring metal, such as beryllium copper, about 0.005 in thick, and is cut with a series of slots 31 and 32 along opposite edges to divide the strip into two series of spring fingers 33 and 33'. The contact member 30 is bent into a circular shape and opposite ends joined together. The spring fingers 33 and 33' extend axially of the assembly and are bent at their free ends into two substantially U-shape resilient portions 34 and 34'. The fingers, 33 and 33' are separated from one another by a straight intermediate portion 36 provided by the central part of the contact strip. The resilient portions 34 and 34' each have a straight inclined ramp 37 and 37' directed centrally of the contact strip and bent upwardly at its free end into a contact region 38 and 38' of curved profile. The left hand ramp 37 forms a flared opening to the contact member 30. The contact member 30 is located within the recess 26 around the coupling ring 23, with the straight intermediate portion located on the floor of the recess. In this position, the free end of the right hand resilient portion 34' contacts an annular contact region 28 around the outer surface of the shell 20 at its left hand end, in the region of the teeth 27, and is compressed slightly radially outwardly, so that a solid electrical contact is established between the shell 20 and contact member 30.

The backshell 2 is brought up to the rear of the connector 1 and the thread 25 on the backshell coupling ring 23 is engaged with the thread 15 on the shell 10 of the connector 1. The coupling ring 23 is rotated about the backshell 2 to draw the two parts of the coupling further into engagement. As the rear of the connector 1 enters the flared, rear end of the grounding contact member 30, the contact region 38 makes sliding electrical contact with the contact region 16 at the rear end of the shell 10, the external diameter of the shell 10 being slightly greater than the internal diameter of the contact member 30 in its contact region 38. Rotation of the coupling ring 23 does not cause rotation of the grounding contact member 30 because this is not attached to the coupling ring 23 by welding or otherwise. When the coupling ring is rotated to its full extent the teeth 17 are in engagement with teeth 27 and the spring fingers 33 and 33' establish an effective electrical interconnection between the two shells 10 and 20, independently of the coupling ring 23.

The grounding contact member 30 has the advantage that it can be preformed into a circular shape before assembly into the coupling, which enables a close control to be maintained on the finished dimensions. The contact member 30 is easily clipped into the recess 26 in the coupling ring 23 and the ring 23 subsequently pushed rearwardly onto the shell 20 of the backshell 2. As this happens, the rear resilient portion 34' is deformed and is urged into electrical contact with the outside shell 20. Because the contact member 30 is assembled before the coupling ring 23 it enables quality and electrical testing of the assembled contact member 30 to be carried out more readily. The simple shape of the spring fingers 33 and 33' makes them easy to manufacture. The resilience of the contact member 30 also helps reduce the effects of vibration on the coupling by damping out the vibration, even if the coupling ring should become loose. The contact member 30 also helps to maintain electrical continuity between the two shells 10 and 20 even if the coupling ring 23 should become loose. It can be seen, therefore, that the electrical continuity through the coupling has a very high integrity. This is very important in that it ensures that the electrical screening of any system including the coupling is maintained. This gives the system a high immunity to electrical magnetic interference (EMI) and lightning strikes.

Figure 5:
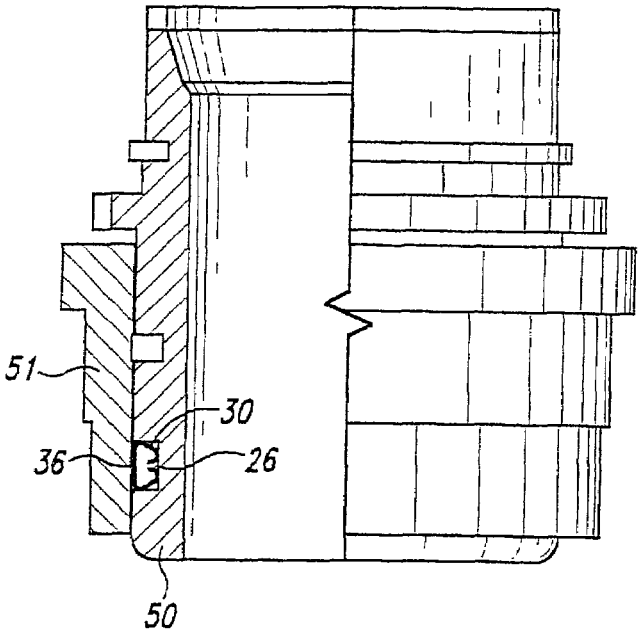
FIG. 5 is a sectional elevation of a modified assembly.

It will be appreciated that the grounding contact member 30 could be use to ensure a good electrical path between other parts of a coupling or between parts of two mating couplings For example, as shown in FIG. 5, the contact member 30 is used to make electrical connection between an inner member 50 and an outer rotatable member 51. In the arrangement illustrated, the contact member 30 is located in a recess 26 around the outer surface of the inner member 50 with its intermediate portion 36 facing outwardly to engage the inner surface of the outer member 51. Alternatively, the contact member 30 could be located in a recess around the inner surface of the outer member 51.

What is claimed is:

1. An electrical coupling and components of coupling having electrical grounding contact members comprising:

a first metal member;

a second rotatable member with an annular recess formed around its inner surface and mounted on a part of the first member; and an electrical grounding contact member located in the annular recess arranged to engage the outer surface of the first member and the inner surface of the second member wherein the contact member maintains electrical continuity by its spring shape formed from a conductive strip or band with a series of slots along opposite edges to divide said strip into two series of spring contact fingers extending axially; said spring contact fingers bent inwardly into first and second resilient U-shaped portions; said spring contact fingers separated from one another by a straight intermediate portion provided by the said conductive strip, the resilient portions each having a straight inclined ramp directed centrally of said conductive strip and bent upwardly at its free ends into a contact region of curved profile, said left hand ramp forming a flared opening to said contact member; and said grounding contact member disposed so that a solid electrical contact is established between said grounding contact member and outer shell of said electrical coupling.

2. A coupling according to claim 1, wherein the first member is a first shell and the second member is a coupling ring.

3. A coupling according to claim 2, wherein the annular recess is formed around the inner surface of the said coupling ring.

4. A coupling according to claim 3, wherein the contact member is entirely enclosed within said coupling ring.

5. A coupling ring according to claim 4, wherein said contact member is of beryllium copper or of conductive metal.

6. A coupling according to claim 1, wherein one end of the contact members' contacts said first shell and the other end of the contact member is arranged for contact with an outer surface of a second shell.

7. A coupling according to claim 3, wherein said first shell is formed with teeth around one end arranged to engage teeth on the second shell, and wherein the fingers at one end of the contact member contact an outer surface of the first shell in a region of teeth.

8. A coupling according to claim 1, wherein the contact member includes an annular band, wherein said conductive band encircles the first member and is integral with said spring fingers, and wherein said fingers project from the opposite edges of the band.

* * * * *